United States Patent [19]

De Jule

[11] 4,227,114

[45] Oct. 7, 1980

[54] CATHODOLUMINESCENT GAS DISCHARGE IMAGE DISPLAY PANEL

[75] Inventor: Michael C. De Jule, Chicago, Ill.

[73] Assignee: Zenith Radio Corporation, Glenview, Ill.

[21] Appl. No.: 769,127

[22] Filed: Feb. 16, 1977

[51] Int. Cl.[3] ..... H01J 63/04; H01J 61/06

[52] U.S. Cl. ..... 313/217; 313/210

[58] Field of Search ..... 313/217

[56] References Cited

U.S. PATENT DOCUMENTS

| | | | |
|---|---|---|---|
| 3,622,829 | 11/1971 | Watanabe | 315/169 R X |
| 3,662,214 | 5/1972 | Lustig | 315/167 |
| 3,701,918 | 10/1972 | Allen et al. | 313/209 |
| 3,742,483 | 6/1973 | Ogle | 315/169 TV |
| 3,749,969 | 7/1973 | Miyashiro et al. | 315/169 TV |
| 3,800,186 | 3/1974 | Yamane et al. | 315/169 TV |
| 3,801,864 | 4/1974 | Yamane et al. | 315/169 TV |
| 3,831,052 | 8/1974 | Knechtli | 313/187 |
| 3,875,442 | 4/1975 | Wasa et al. | 313/193 |
| 3,882,342 | 5/1975 | Kamegaya et al. | 313/188 |
| 3,938,135 | 2/1976 | DeJule et al. | 313/188 X |
| 3,956,667 | 5/1976 | Veith | 315/169 TV |
| 3,992,644 | 11/1976 | Chodil et al. | 313/217 |
| 3,999,094 | 12/1976 | Chodil | 313/192 |

FOREIGN PATENT DOCUMENTS 1433256 6/1973 United Kingdom .

OTHER PUBLICATIONS

Hori et al. "A Picture-Display Panel Using a Constricted -Glow Discharge," IEEE Transactions on Electron Devices, vol. ED-21, #6, Jun. 1974; pp. 372-376.

Okamoto et al, "Electron Accelerating Plasma Display Cell," Preprint #464 of the 1975 national meeting of the Institute of Electrical Engineers of Japan, 1975.

Okamoto et al. "A New DC Gas Discharge Display With Internal Memory," Japan J. Appl. Phys. vol. 15(1976), #4.

German patent disclosure 26 01 925; 7/76 (translation)

Glugge, "Gas Discharge II," Encyclopedia of Physics, vol. XXII; Ed. Springer-Verlag, Berlin; 1956; pp. 151-152.

Andrews et al. "Theory of a double sheath between two plasmas," Proc. of the Royal Society of London, A 320, pp. 459-472, 1971.

Hori et al, "A New Gas-Discharge Display Device Using Through-Hole Enhancement," Conference Record, 1970 IEEE Conference on Display Devices, pp. 140-143.

Crawford et al. "The Double-Sheath at a Discharge Constriction," Microwave Laboratory, Stanford University; pp. 462-464 (no date).

Francis, "The Glow Discharge at Low Pressure," Encyclopedia of Physics; pp. 53-61 (no date).

Weston, "Cold Cathode Glow Discharge Tubes," London ILIFFE Books Ltd; 1968; pp. 63-65 & 281-287.

Penning, "Extract from Anomalous variations of the sparking potential as a function of pod;" Proc. Roya Academy of Sciences, Amsterdam 34, 1305(1931); pp. 204-210.

Gelder et al. "Principles and Techniques in Multicolor DC Gas Discharge Displays," pp. 1019-1024, Pcdgs IEEE, vol. 61, #7; Jul. 1973.

Mizushima et al., "Electron Accelerating Plasma Display Cell," preprint #463, IEEJ, 1975.

Okamoto et al., "Electron Accelerating Plasma Display Cell," preprint #1064; IECEJ, 1975.

Okamoto et al. "Electron Accelerating Plasma Display Cell," prepring #18-2 of 1975 Nat'l Meeting of J. TV Society.

Hitachi Ltd. "Plasma Display Panel of an Electron Accelerated Type," by Okamoto et al ED 75-58.

*Primary Examiner*—Robert Segal

*Attorney, Agent, or Firm*—Ralph E. Clarke, Jr.

[57] ABSTRACT

This disclosure depicts a high-voltage cathodoluminescent gas discharge image display panel having an ordered array of display elements. The panel includes envelope means containing an ionizable gas at a predetermined very low pressure. The envelope means includes a transparent faceplate on the inner surface of which are disposed cathodoluminescent target elements. Electron source means produces at a given time at least one high-density electron beam, and includes means to cause a plasma sac to generate and gather electrons, and accelerate them to form a concentrated electron beam. An ultor electrode receiving a predetermined relatively high ultor voltage establishes a high voltage gradient in a plasma-free acceleration section which is effective to straight-line accelerate said electron beam in a substantially collision-free path directly into high-energy bombardment of the cathodoluminescent target elements. The panel includes light-stopping means whereby the useful visible light is solely that produced by high-energy electron bombardment of the target elements. Other structures including means for electron beam modulation are disclosed.

6 Claims, 13 Drawing Figures

CATHODOLUMINESCENT GAS DISCHARGE IMAGE DISPLAY PANEL

CROSS REFERENCE TO RELATED PATENT APPLICATIONS

This application is related to but in no way dependent upon copending application of common ownership herewith assigned including Ser. No. 588,737 filed June 20, 1975; now U.S. Pat. No. 3,992,644, issued July 4, 1978; Ser. No. 730,114 filed Oct. 6, 1976; now U.S. Pat. No. 4,009,082, issued July 4, 1978; and Ser. No. 828,792 filed Aug. 29, 1977 now U.S. Pat. No. 4,009,032, issued Dec. 19, 1978.

BACKGROUND OF THE INVENTION AND PRIOR ART STATEMENT

This invention relates to image display panels. It is particularly directed to a highly efficient cathodoluminescent panel useful for image displays such as alphanumeric and computer graphics, and well suited to television displays.

Although the field of the gas discharge display panel has been diligently explored, no device has yet been able to meet the standards of performance and cost as high as those established by the cathode ray television picture tube in its current state of development.

Ideally, the gas discharge display panel offers many benefits. First of all, it is not size-limited as stringently as the picture tube, wherein any increase in picture area much greater than the twenty-five inch diagonal measure results in an inordinate increase in bulk and weight. For example, a picture tube with a twenty-five inch diagonal measure weighs about fifty pounds while a tube with a thirty inch diagonal measure may weigh more than a hundred pounds. To cite other advantages, flat panel displays, which are commonly built in a matrix of linear rows of columns of discrete picture elements, are inherently capable of producing pictures of near-perfect raster linearity, interlace and color field registration. But these theoretical benefits have been largely offset by undesirable performance characteristics such as inadequate brightness, low luminous efficiency, luminance non-uniformity, and lack of contrast.

Of these problems, inadequate brightness and low luminous efficiency have proved to be among the most troublesome impediments to commercial viability. The maximum level of brightness produced by a discrete picture element in prior art gas discharge panels has been but a fraction of the brightness level of an equivalent picture element in a television picture tube. As a consequence, it has not been feasible to scan gas discharge picture elements point-at-a-time as is done in the picture tube and yet achieve an acceptable brightness level. However, a greater level of brightness can be obtained in gas discharge panels by operating a full line of display panel picture elements at a time. Even by this expedient, however, a brightness level adequate for comfortable television viewing, and competitive with the current television picture tubes, has not been shown.

Luminance non-uniformities have also proved troublesome in display panels. This problem may manifest itself as spots, rings or striations of light brighter than surrounding areas of the image field. These manifestations may remain fixed, or move about. Since the human eye is particularly sensitive to even slight differences in luminance intensity, the effects can prove deleterious, especially in panels used for the reproduction of images having a full gray scale, such as the television picture.

Operation of the gas-discharge display panel is based upon the principles of the widely known glow-discharge tube, an example of which is shown by FIG. 1. Enclosed within an evacuated envelope 12 is cathode 14 and an anode 16. Envelope 12 may contain one of the noble gases such as krypton or argon, or common gases such as nitrogen, hydrogen, mercury vapor, or a mixture thereof. A suitable potential applied between cathode 14 and anode 16 results in a glow discharge within the envelope. The entity exhibits classic gas discharge phenomena including a cathode dark space 20, a negative glow 22, a Faraday dark space 24, and a positive column 26.

FIG. 2 shows an element of a prior art gas discharge display panel for producing spots of light utilizing the medium of the gas discharge tube. In essence, an intermediate apertured insulator 30 is located in a positive column 32 of a gas discharge cell 33. A "plasma sac" 34 (also called an "electrostatic double layer" in the art) forms on the cathode side of the aperture 31. Primary electrons from the cathode 35 generate secondary electrons in the gas discharge and are gathered by the plasma sac 34 and channeled into aperture 31. Light visible to the viewer, indicated by 36, is produced within sac 34 due to the higher electron temperature within the sac as compared to the electron temperature outside the sac. The phenomenon is described in a journal article entitled "A Picture-Display Panel Using a Constricted Glow Discharge", by H. Hori et al, IEEE transactions on Electron Devices, Vol. ED-21, No. 6. June, 1974. A gas discharge display apparatus utilizing the plasma sac is disclosed by Miyashiro et al in U.S. Pat. No. 3,749,969.

Further with regard to FIG. 2 and the concept it represents, it is said that a gas such as neon can be used at a nominal pressure of five torr. An intermediate electrode 38 plated inside aperture 31 is used for propagation of the plasma sac 34 to an adjacent aperture having a similar intermediate electrode (not shown). Propagation is due to a priming effect in that the presence of the discharge in one aperture lowers the breakdown voltage of a discharge in an adjacent aperture to encourage the formation of a plasma sac in that aperture. At the same time, the discharge in the first cell is switched off. Thus, by this scheme, point-by-point scanning can be obtained, and as luminance is a linear function of current, the intensity of the light 36 can be varied so intermediate values of gray of limited scope can be obtained.

Another approach followed by the prior art is to utilize ultraviolet emissions emanating from a positive column to stimulate the emission of light in the visible spectrum.

A phosphor is disposed on the transparent walls of the cavity surrounding the positive column. One execution of this approach utilizes the plasma sac phenomenon as described in a journal article by H. Hori et al (Op. cit.), but alleges to be an improvement thereon in that it is said to utilize a more efficient ultraviolet excitation of phosphors from a positive column, rather than a negative glow luminance light production phenomenon taught by Hori. The method of ultraviolet excitation of phosphors is described in "Electron Accelerating Display Cell," Y. Okamoto et al, Preprint Number 464 of the 1975 national meeting of the Institute of Electrical Engineers of Japan, 1975.

According to the referenced document, the device is said to be operable in three modes, as illustrated by FIGS. 2A, 2B, and 2C. It will be observed that the gas discharge cell structures in the figures are identical, in that each has a cathode 1 and associated negative glow, an anode 2 and intermediate electrode 3 having an aperture therein, and a phosphor 4 disposed on an inner surface of evacuated, gas-charged envelope 5. The particular mode that develops in these common configurations depends upon the potential on anode 2; that is, a progressive increase in levels of potential on anode 2 results in modes I, II, and III as shown in FIGS. 2A, 2B, and 2C respectively. Mode II is the favored mode and would seem to be the most feasible mode of operation, with modes I and II considered as not being viable for display applications.

With regard to the operation of mode I illustrated by FIG. 2A, electrons generated in the interspace between cathode 1 and intermediate electrode 3 diffuse into display cell area 6 and are accelerated by relatively low potential on anode 2, said to be on the order of 200 volts or less. An electron e may follow a typically random collison-determined path 7 to impinge upon low-voltage phosphor 4, causing emission of light 8. Alternatively, an electron e following path 9 may collide with an atom 11, resulting in the emission of ultraviolet light which, upon impact with phosphor 4, also results in the emission of visible light 8A. It appears that no positive column is generated in mode 1 operation.

With regard to FIG. 2B and mode II operation, a relatively greater potential on anode 2, assumed to be more than 200 volts, results in the formation of a positive column 13 which emits abundant ultraviolet light for the excitation of phosphor 4. When a predetermined threshold level is reached in the discharge current, a plasma sac 15 forms. Plasma sac 15 provides for amplification of the electron current drawn through the aperture in intermediate electrode 3, providing for greater phosphor excitation than mode I through enhanced ultraviolet emission from positive column 13.

In mode III operation shown by FIG. 2C, a potential said to be even greater on anode 2 causes the intermediate electrode 3 to become a second cathode, as shown by the presence of a second negative glow 17. A positive column 19 also appears, resulting in photoluminescence as in mode II. The presence of the negative glow 17, however, causes the discharge current to "run away," as a self-sustained discharge develops between intermediate electrode 3 and anode 2 as in an ordinary gas discharge. To prevent this run-away condition a resistive entity (not shown) must be placed in series with the intermediate electrode 3. This in turn reduces the panel speed response as compared with preferred mode II. (See "A New DC Gas Discharge Display With Internal Memory," Y. Okamoto et al. Japan J. Appl. Phys. Vol. 15 (1976), No. 4; also, Patent Disclosure No. 26 01 925 (German).

Schwartz, in U.S. Pat. No. 3,845,241 discloses a gas discharge structure as a source of free electrons which are accelerated in an adjoining, second section into impingement with an electron-excitable phosphor screen. Establishment of a gas discharge in the second section is precluded by appropriate selection of certain dimensions, gas pressure and accelerating voltage according to Paschen's law. Moderating means are provided in certain embodiments for causing the energy range of free electrons entering the second section to be narrow relative to the range of energies of free electrons generated in the gas discharge. A number of control grid arrangements are also disclosed.

Displays in which a light-emissive material is directly excited by electron bombardment are known as cathodoluminescent displays. Obtaining an adequate number of electrons for adequate excitation of the light-emissive material, and hence adequate brightness, has been a problem in panel displays utilizing cathodoluminescence, as the standard planar cathode in its present state of development does not yield enough electrons at low gas pressures for an effective display. To remedy this deficiency, a structure known as a "hollow cathode" has been introduced into cathodoluminescent panel displays. The use of a hollow cathode in gas discharge displays and the advantages thereof, are disclosed in U.S. Pat. Nos. 3,992,644 3,938,135 and 3,999,094 assigned to the assignee of the present invention.

OTHER RELATED PRIOR ART

Luminance non-uniformity in the form of anode spots is the topic of an article in the *Encyclopedia of Physics,* "Gas Discharge II" Vol. XXII, S. Flügge, Ed. Springer-Verlag, Berlin. 1956. Pp. 151–152.

Examples of the use of hollow cathodes in gas discharge displays and in other applications may be found in U.S. Pat. Nos. 3,662,214; 3,701,918; 3,831,052; 3,875,442; 3,882,342.

With regard to prior art disclosing a plasma sac, the following are cited: An article entitled "Theory of a Double Sheath Between Two Plasmas", by J. Andrews and J. Allen, Proc. of the Royal Society of London, A 320 Pp. 459–472. 1971; an article entitled "A New Gas-Discharge Display Device Using Through-Hole Enhancement", H. Hori et al. Conference Record, 1970 IEEE Conference on Display Devices, Pp. 140–143; and an article entitled "The Double Sheath at a Discharge Constriction", by F. Crawford and I. Freeston, Microwave Laboratory, Stanford University.

Patents relating to plasma sac technology and display panels having relevance in general include: U.S. Pat. Nos. 3,622,829; 3,800,186; 3,801,864; 3,956,667 and Patent Specification No. 1 433 256, Great Britain.

The glow discharge tube shown by FIG. 1 is an excerpt from a section of the *Encyclopedia of Physics* titled "The Gas Discharge at Low Pressure", by Gordon Francis. (Op. cit.) P. 56.

Priming and self-scanning, deionization and recovery time are discussed in a book entitled *Cold Cathode Glow Discharge Tubes,* by G. F. Weston. ILIFFE Books Limited. 1968. Pp. 63–65, and 281–287.

Further relevant art includes: "Extract From 'Anomalous Variations of the Sparking Potential as a Function of PD'," by F. Penning. Reproduced from Proc. of the Royal Academy of Sciences, Amsterdam 34, 1305 (1931), from *Electrical Breakdown in Gases,* J. Rees, Ed. John Wiley & Sons; and "Principles and Techniques in Multicolor DC Gas Discharge Displays." Z. Van Gelder and M. Mattheij. Pp. 1019–1024; "Electron Accelerating Plasma Display Cell," a series: Preprint No. 463; Mizushima et al, IEEJ, 1975; Preprint No. 1064, Okamoto et al, IECEJ, 1975; Preprint No. 18–2, Okamoto et al; and "Plasma Display Panel of an Electron Accelerated Type," Okamoto et al. ED75–58. Hitachi Ltd.

OBJECTS OF THE INVENTION

It is a general object of this invention to provide an improved gas discharge display panel.

It is another object of this invention to provide a gas discharge display panel having an image brightness, luminance uniformity, luminance efficiency, and contrast and color reproduction capability comparable to the present television cathode ray picture tube;

It is a further object to provide a display panel having a structure that is relatively simple and easy to manufacture;

It is yet another object of this invention to provide a display that is fully compatible with NTSC standards and that can utilize standard television broadcast signals.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with the accompanying drawings in which:

DESCRIPTION OF THE PREFERRED EMBODIMENT

This invention is particularly related to gas discharge image display devices wherein a gas discharge is used as a source of electrons. To add clarity to the description that follows, certain illustrative dimensions and values are given in the course of the specification, but in no manner are they to be considered limiting.

Figure 1:
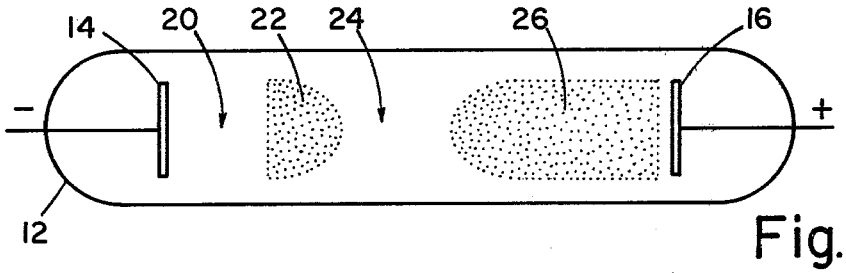
Fig. 1 PRIOR ART
FIG. 1 is a schematic view of a glow discharge tube of a type widely known in the art.
Figure 2:
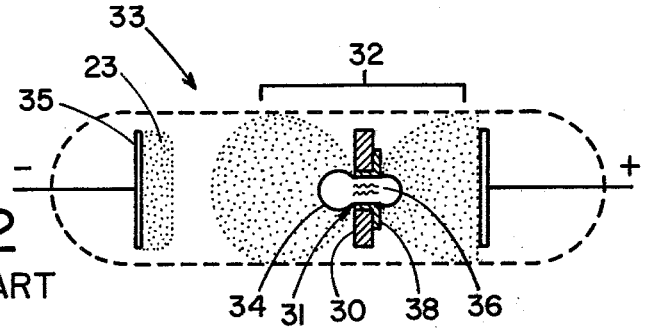
Fig. 2 PRIOR ART
FIG. 2 illustrates in schematic form an element of a prior art gas discharge display panel wherein the visible light source is a plasma sac.
Figure 3:
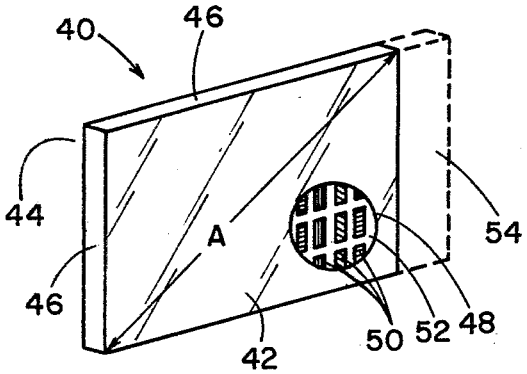
FIG. 3 is a highly simplified representation of a display panel constructed according to the teachings of this invention.

With reference to FIG. 3, there is shown figuratively a very-low-pressure, high-voltage cathodoluminescent display panel 40 having an aspect ratio of three to four consonant with the aspect ratio of a standard television picture. The invention lends itself to a broad range of display sizes; for example, from nine inches to fifty inches in diagonal measurement (A), representing a practical range of interest for television viewing. The basic construction of a panel envelope 40 is shown by FIG. 3 in simplest form. Transparent faceplate 42 and back wall 44 are separated by side plates 46. All abutting faces are sealed to make an envelope which can be air-evacuated. The air is replaced by a suitable gas, or mixture of gases, at a predetermined very low pressure according to this invention. The panel envelope representing a preferred embodiment of this invention as described in this disclosure may have a front-to-back dimension of from about one to three inches in the thirty-inch diagonal measure size. This relative thinness is made possible by the fact that the surfaces of faceplate 42 and back wall 44 can be made fully self-supporting because of the nature of the internal structure, as will be shown. Because of this self-supporting ability, which represents an aspect of the preferred embodiment, the faceplate 42, which may, for example, be made from tempered plate glass, can be one-eighth of an inch thick or less. Similarly, back wall 44, which is also supported internally, can be equally thin. The value of this self-support is shown by the fact that the pressure on the faceplate and the back panel of a television display panel having a fifty-inch diagonal measurement may approach nine tons.

Section 48 of FIG. 3 represents a very small area of the faceplate 42 greatly enlarged to show an ordered array of red-light-emitting, green-light-emitting and blue-light-emitting cathodoluminescent target elements 50. To enhance color purity and contrast, and to reduce front reflection, each target element 50 may be surrounded by a light-absorptive material 52. The ancillary electronic circuits, which in the case of the television display would include circuits for video processing, are shown schematically as being contained in electronic section 54.

Figure 4:
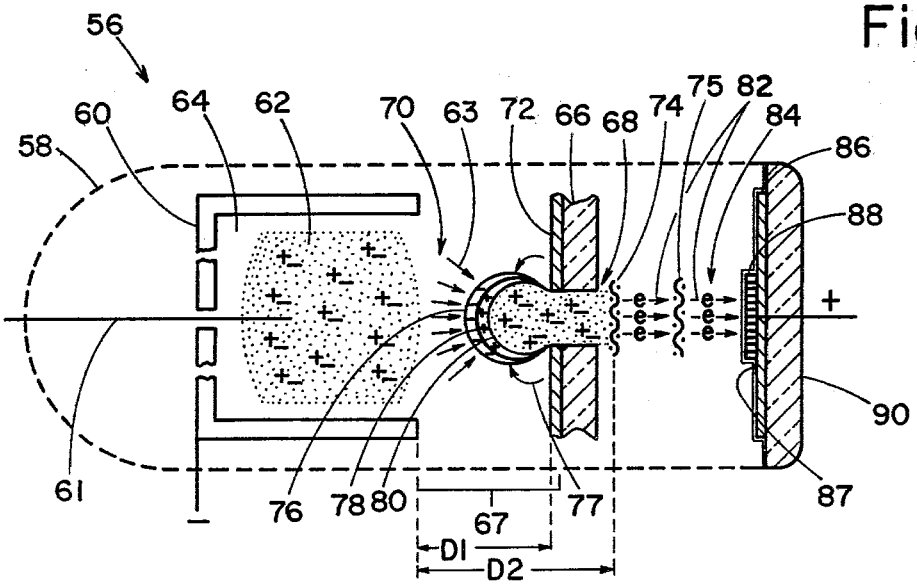
FIG. 4 is a simplified schematic illustration of a single gas discharge display element representing a preferred mode of execution of the invention.
Figure 2A:
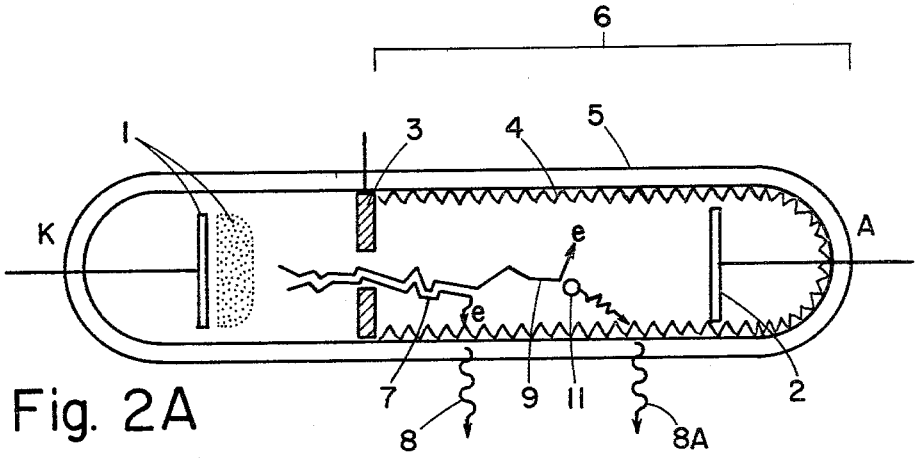
Fig. 2A PRIOR ART
FIGS. 2A, 2B, and 2C are highly schematic views of three operating modes of a prior art display device which stimulates the emission of light by ultraviolet radiation.
Figure 2B:
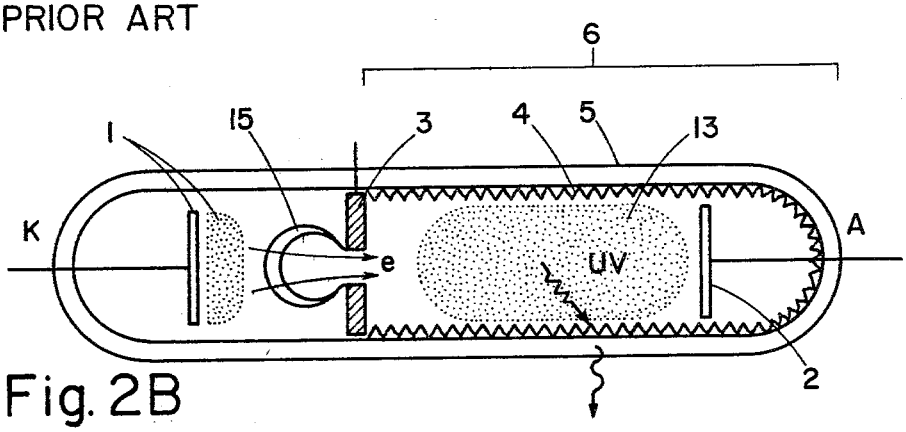
Fig. 2B PRIOR ART
Figure 2C:
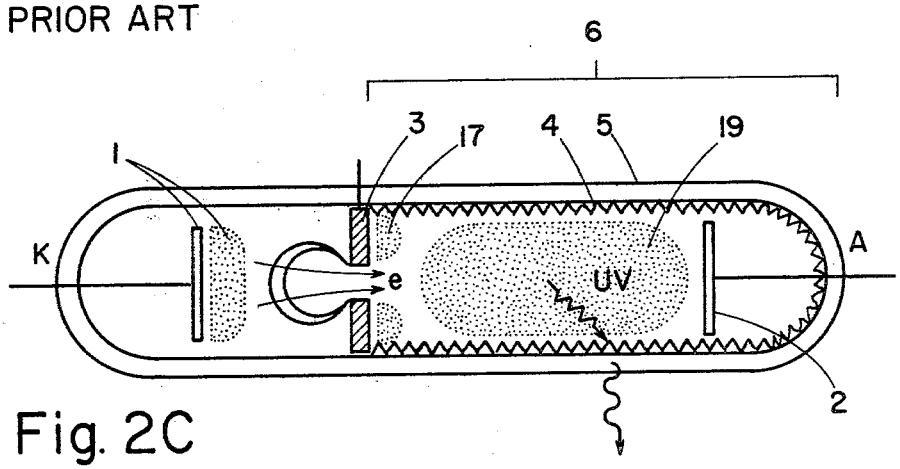
Fig. 2C PRIOR ART

FIG. 4 illustrates a single gas discharge display element 56 comprising the preferred embodiment of this invention. As used herein, the term "display element" is intended to mean those structures and partial structures which cooperate to define a single picture element of the panel. Display element 56 as shown and described is to be considered as a microcosm of each of the hundreds of thousands of identical elements which, for example, may be incorporated into the figurative television display panel 40 shown by FIG. 3. To contribute to a thorough understanding, the inventive concepts of the preferred embodiment of the invention shown by FIG. 4 will be listed first in brief, followed by a detailed functional description.

Display element 56 is shown as being enclosed in an evacuated envelope containing an ionizable gas at a predetermined very low pressure. Envelope 58, indicated by a broken line in FIG. 4, symbolically represents the panel-form envelope 40 shown in FIG. 3. The components according to the preferred embodiment of this invention comprise a rearwardly disposed hollow cathode 60 for receiving a relatively low applied voltage. Electron-transmissive anode 74 is spaced a predetermined distance from cathode 60 and receives a relatively intermediate applied voltage. Constriction-forming means 66 located between cathode 60 and anode 74 define a constriction 68. A performance enhancement electrode 72 is located between cathode 60 and anode 74. Between cathode 60 and performance enhancement electrode 72 lies the Faraday dark space 70. The intermediate applied voltage of anode 74, the predetermined distance distance between cathode 60 and anode 74, the very low gas pressure, and the individual width of constriction 68 have values effective to support a gas discharge between cathode 60 and anode 74, and to cause a plasma sac 76 to form in the plasma on the cathode side of constriction-forming means 66. The plasma sac 76, by its nature, generates and gathers electrons from cathode 60 and accelerates them into constriction 68 to form a concentrated electron beam therein.

An ultor electrode 86 is disposed contiguous to cathodoluminescent target element 88 on transparent faceplate 90 for receiving a predetermined relatively high ultor voltage. Ultor electrode 86 is separated by predetermined spacing from grid 75 to define an acceleration section 84 therebetween. This predetermined spacing is so small that at the predetermined very low pressure and at the ultor voltage cited, no gas discharge plasma can possibly occur in acceleration section 84. The operating point is to the left of the Paschen curve minimum (more later on this). The ultor voltage establishes a high-voltage gradient in the plasma free acceleration section 84 which is effective to straight-line accelerate the beam of electrons 82 formed in constriction 68 in a substantially collision-free path directly into high-energy bombardment of the cathodoluminescent target element 88 disposed on faceplate 90.

Light-stopping means, here shown as including a continuous, light-reflecting layer 87, blocks from view the light produced by the plasma whereby useful visible light produced by the panel is solely that produced by the high-energy electron bombardment of the cathodoluminescent target element 88 disposed on faceplate 90. Ultor electrode 86 as shown is light-transmissive. The grid means comprises anode 74 and at least one electron-transmissive modulating grid means 75 located down-beam of anode 74.

Figure 7:
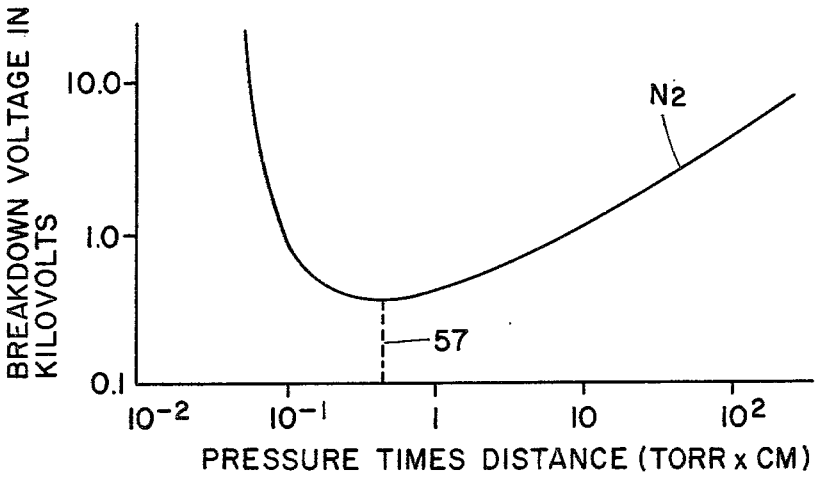
FIG. 7 is a "Paschen" curve illustrating a relationship between pressure, path length, and breakdown voltage in a gas discharge display element.

A detailed functional description of the preferred embodiment of the invention as illustrated by FIG. 4 now follows. The ionizable gas enclosed in evacuated envelope 58 may comprise a single gas, or a mixture of gases according to this invention. Typical gases that may be used in the panel are the noble gases such as krypton and argon, or the more common gases such as hydrogen, nitrogen, mercury vapor or mixtures thereof, such as a Penning mixture. A preferred gas according to this invention is pure nitrogen; a typical Paschen curve for nitrogen is shown by FIG. 7. The gas pressure is a fraction of a torr for electrode spacings of a few millimeters, and operation is well to the left of the Paschen minimum 57. A useful operating point, for example, occurs at 0.06 torr-centimeters. This corresponds, e.g., to a pressure of 0.2 torr with the electrodes 75 and 86 separated by 0.3 centimeters in the plasma-free acceleration region. The benefits of panel operation at this very low pressure will be described in relation to component operation in the following description.

The U-shaped configuration of rearwardly disposed hollow cathode 60 creates an efficient collecting cavity that traps metastable atoms, ions and ultraviolet photons on the enclosing walls, liberating as a result copious electrons. Also, electrons are reflected inside the cavity to provide a "circulating" electron current to greatly enhance the probability of ionizing gas atoms. This circulating current permits operation at lower gas pressures than with a planar cathode. The hollow cathode effect is evident at low gas pressure as the negative glow, which normally covers each metal surface in a sheath at high gas pressure, merges into one large negative glow which comprises a plasma in the center of the hollow cathode at low pressure. The effect is shown schematically in FIG. 4 as plasma 62 is surrounded by a cathode dark space 64. The hollow cathode may, e.g. be at a potential of approximately minus 300 volts.

In the FIG. 4 configuration, one hollow cathode 60 is shown as supplying one plasma sac 76 with a flow of electrons 63 within one display element 56. In the preferred embodiment of this invention, however, a single hollow cathode is not so limited in area, but preferably spans a predetermined number of rows and columns of display elements. Within a large-area hollow cathode configuration, a single plasma sac, or group of sacs, may draw electrons from the large area within the hollow cathode.

The use of the hollow cathode in the preferred embodiment of this invention provides many benefits. In addition to providing copious electrons, the hollow cathode offers the fast switching characteristics of the planar cathode and provides efficient operation at higher current levels. Another benefit lies in the fact that the hollow cathode functions efficiently at very low values of "Pd" (gas pressure times distance) between the anode and the cathode which as mentioned, and with reference to FIG. 7, is, for example, 0.06 torr-centimeters in pure nitrogen. This ability of the hollow cathode to function at very low Pd values provides, in turn, a singularly desirable characteristic; that is, the ability to produce at a given time one or more high-density electron beams for high-energy bombardment of cathodoluminescent target elements without forming a gas discharge plasma in the acceleration section. The accelerating section 84 is the region between modulating grid 75 and the accelerating electrode—ultor electrode 86.

The break-down voltage between the hollow cathode 60 and performance enhancement electrode 72 is of the order of a kilovolt. This relatively high breakdown voltage exceeds the capabilities of standard transistor circuits where it may be desirable to selectively pulse groups of hollow cathodes in a display. This voltage can be reduced, however, to a few hundred volts by first priming the hollow cathode with an auxiliary, or priming discharge. A feasible means for producing such a priming discharge is by the use of the ignitor wire 61. As shown by FIG. 4, ignitor wire 61 extends into the approximate center of cathode 60. The ionization of the gas in the vicinity of ignitor wire 61 as electrons orbit the wire and are trapped in the wire's radial field, effectively lowers the breakdown voltage to a few hundred volts. During operation, there is only a small trickle of current through ignitor wire 61, providing a "keep alive" current so that hollow cathode 60 remains in a primed condition wherein its breakdown voltage may be less than 400 volts, for example. Ignitor wire 61 may be energized by a pulse or by a steady flow of current. The use of an ignitor wire as shown is not mandatory in the preferred embodiment of this invention; other hollow cathode priming means may be used such as, for example, a point electrode located near the side of hollow cathode 60.

This invention is no way limited to the use of the hollow cathode as an electron source. A planar cathode, for example, especially designed to be highly efficient, could as well be used. Also, in the interest of energy conservation, it is well within the scope of this invention to utilize other sources of electrons such as provided by field emission. Conventional thermionic cathodes, while increasing power consumption, could as well be used; however, the large thermal time lag would restrict the ability to switch groups of such cathodes on and off where it is desired to cause the plasma sac to move to different locations while scanning a display panel. Whatever type of cathode is used, it should preferably meet the performance standards set by the hollow cathode as described in the foregoing.

Further with regard to FIG. 4, electron-transmissive anode 74 is located forwardly of cathode 60 and is spaced a predetermined distance from cathode 60 for receiving a relatively intermediate applied voltage. Constriction-forming means 66 is disposed between anode 74 and cathode 60, and defines at least one constriction as will be described infra.

Performance enhancement electrode 72 is shown as being a distance $D_1$ from cathode 60, with anode 74 being at a greater distance $D_2$ from cathode 60. Performance enhancement electrode is located contiguous to and parallel with constriction-forming means 66, which is shown as being an insulator, and receives a voltage intermediate to the relatively intermediate voltage on anode 74 and the relatively low voltage on cathode 60. Constriction-forming means 66 defines at least one constriction 68 registered with a construction in performance enhancement electrode 72. These registered constrictions are respectively associated with one or more display elements 56, as will be shown. The intermediate voltages cited, the distance $D_2$, the very low gas pressure and the width of the registered constrictions have values effective to support a gas discharge plasma between cathode 60 and anode 74 and to cause a plasma sac 76 to form in the plasma about constriction 68 in performance enhancement electrode 72 on the cathode side of constriction-forming means 66. The plasma sac by its nature generates and gathers electrons from a large area of hollow cathode 60 and accelerates them into registered constriction 68 to form a concentrated electron beam therein.

The performance enhancement electrode provides several functions. For example, it serves to stabilize plasma sac 76 in registered constriction 68 by conducting electrons from a surrounding area to plasma sac 76, and thus discourages the formation of a sac in non-energized neighboring constrictions. Performance enhancement electrode also serves to prime the contained gas in the region of said constriction, thereby permitting a plasma sac 76 to be established in constriction 68 by application of a lower voltage on anode 74 than otherwise possible, and is believed to supply electrons to sac 76, as shown by arrows 77. The performance enhancement electrode thus appears to act as both an anode and a cathode—an anode which assists in establishing a gas discharge between cathode 60 and anode 74, and a cathode by supplying electrons to plasma sac 76.

The performance enhancement electrode also contributes to the luminance uniformity of the display panel. Non-uniformities may appear in certain types of prior art displays as steady-state or moving spots, rings or striations of light. These undesired phenomena are attributed to the concentration of current on the surface of a small area electrode facing the cathode. Such concentrations are thought to be the result of very slight physical irregularities and/or discontinuities in the planar surface of the facing electrode. The performance enhancement electrode, according to the preferred embodiment of this invention, comprises a conductor having positive potential thereon relative to cathode 60, as noted. It may accomplish the alleviation of luminance non-uniformities by functioning as an equalizer of the electron current in the array of display elements for like element excitation.

As noted, ignitor wire 61 initiates a gas discharge inside the hollow cathode. The performance enhancement electrode 72, functioning as an anode, initiates the discharge outside the hollow cathode 60 in order to prime the plasma sac. Thereafter, a plasma sac forms on the cathode side of constriction 68 when a positive potential of, for example, 150 volts is applied to anode 74. A plasma sac forms when the current demand through constriction 68 exceeds the current that can normally be conducted by the low-temperature plasma near constriction 68. As the voltage is raised on anode 74, a threshold current and voltage is reached wherein plasma sac 76 suddenly forms. The threshold voltage will vary depending on gas pressure, gas constitution, the size of construction 68 and cell-wall geometry. Due to this threshold phenomenon, the plasma sac acts as a "switch" that can be scanned point-to-point in a display. The scanning means and method for the display panel that is the subject of this invention does not represent per se an aspect of this invention, but is described and claimed in U.S. Pat. No. 4,130,777.

Primary electrons from cathode 60 ionize gas atoms and produce secondary electrons. These secondary electrons produce a plasma or "sea" of electrons that then act as the source of electrons from the plasma sac.

Figure 5:
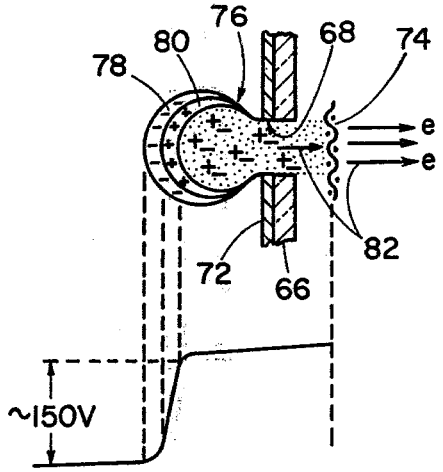
FIG. 5 shows in greater detail the form and the distribution of potentials of the plasma sac shown by FIG. 4.

Plasma sac 76, by its nature, gathers electrons emitted by hollow cathode 60 and accelerates them into constriction 68 to form a concentrated electron beam 82 therein. Referring additionally to FIG. 5, plasma sac 76 is comprised of an outer sheath 78 which comprises a negative space charge layer, and an inner sheath 80 which comprises a positive space charge layer. A potential of about 150 volts (in this example) exists between these two layers as shown by the associated relative-voltage-versus-distance curve of FIG. 5. Electrons are collected and accelerated from the outer sheath 78 into the sac by the 150-volt increase in potential. The 150-volt increase between the two sheaths 78 and 80 provides an impedance-matching function necessary to increase the conductivity of the plasma within constriction 68, and thus allows a higher current to pass through the constriction. The conductivity of the plasma in the area outside the sac is lower than the conductivity of the plasma in the area inside the sac. Low conductivity corresponds to low plasma electron temperature while high conductivity corresponds to high plasma electron temperature, in this case. After electrons are accelerated from the outer sheath 78 into the sac, they may produce additional ionization within the sac itself. This also contributes to the higher current passing within constriction 68.

In addition to being able to gather electrons from cathode 60 and accelerate them into a constriction to form a concentrated electron beam, plasma sac 76 offers another benefit in its ability to move from one constriction to the nearest energized neighboring constriction (not shown) very rapidly; e.g., in a period of less than 200 nanoseconds. This mobility is believed to be adequate for scanning a spot at conventional TV scan rates, which is 125 nanoseconds.

An electron "drift space" can be of value in moderating the relatively high energy of several hundred volts of the electrons emitted by hollow cathode 60. Electron energy can be lowered an order of magnitude to tens of volts, by means of the drift space 67. Drift space 67 of FIG. 4 represents the distance between hollow cathode 60 and constriction-forming means 66, which may, e.g., be about 0.75 inch. In the preferred embodiment of the invention, the drift space comprises the Faraday dark space. The provision of a drift space in display panels is described and claimed in U.S. Pat. No. 3,999,094 to Chodil, assigned to the assignee of this invention.

The concentrated electron beam 82 emerging from constriction 68 passes through electron-transmissive anode 74 and electron-transmissive modulation grid 75, which is disposed between anode 74 and ultor anode 86. The beam is modulated by grid 75 which has thereon a time-varying signal which may range from zero volts through one hundred and fifty volts for example. The time-varying signal may represent television picture information.

The concentrated electron beam 82 now enters acceleration section 84. The ultor voltage of ultor electrode 86 is a voltage in the range of many hundreds to tens of thousands of volts, establishing a high-voltage gradient in the plasma-free acceleration section 84. This relatively high voltage is, in any case, a voltage greater than any one of the discrete voltages or voltage differences existing in the plasma of display element 56, such as the anode fall, cathode fall, positive column, negative glow column, or the voltage differential in the plasma sac. The ultor voltage is effective to straight-line accelerate the beam 82 of electrons (indicated by the symbol e) in a substantially collision-free path directly into high energy bombardment of cathodoluminescent target element 88 disposed on transparent faceplate 90.

Light-stopping means is provided for blocking from view light produced by the plasma, whereby the useful visible light produced by the panel is solely that produced by the high-energy electron bombardment of cathodoluminescent target element 88. The light-stopping means is here shown as including a light-reflective, electrically conductive film 87 (an aluminum layer, e.g.) disposed on cathodoluminescent target element 88. The film 87 may also comprise the ultor electrode.

In accordance with this invention, anode 74 in cooperation with modulating grid 75 located down-beam of anode 74, provides for modulating the concentrated electron beam with a time-varying voltage to provide in cooperation with anode 74 full control of the beam wherein a range of differences in potentials between anode 74 and modulating grid 75 provides a related range of differences in electron current, and thus a related range of differences in luminous output from cathodoluminescent target elment 88. Tests have shown that a gray scale of 1000:1 or more is possible.

When the potential on anode 74 is raised from zero to 150 volts, a plasma sac 76 forms. If the potential on modulating grid 75 is zero, however, there will be no current flow from constriction 68, and display element 56 will effectively be biased to cut-off, and the associated cathodoluminescent target element 88 will not be activated. As the potential on modulating grid 75 is raised, increasing beam current will flow, the level of which is proportional to the voltage level on modulation grid 75 to the point of maximum current flow for maximum luminous output. Thus a full range of grays is provided by the two cooperating grids. In actuality, a lower limit to the gray scale exists because some residual ionization may produce a small amount of background light.

For a display requiring little or no gray scale such as the alphanumeric, display element 56 may comprise only anode 74, without the presence of modulating grid 75. The use of a single electron-transmissive anode 74, which represents an aspect of the preferred embodiment, provides a monochrome image display relatively devoid of intermediate gray tones. By itself, the single anode cannot fully control beam current flow, so there is an abrupt threshold at which the plasma sac 76 forms, and substantial current is initiated. As a result, when only a single grid is used, a very limited range of grays can be obtained due to the high threshold level; that is, nominally a gray scale ratio of about 10 to 1.

In the FIG. 4 embodiment, the components that form the plasma sac; i.e., constriction-forming means 66 and associated parts may lie near the positive column. Constriction-forming means 66 and associated plasma-sac-forming components could as well be located within the positive column, or, in the negative glow region of the gas discharge.

Figure 6:
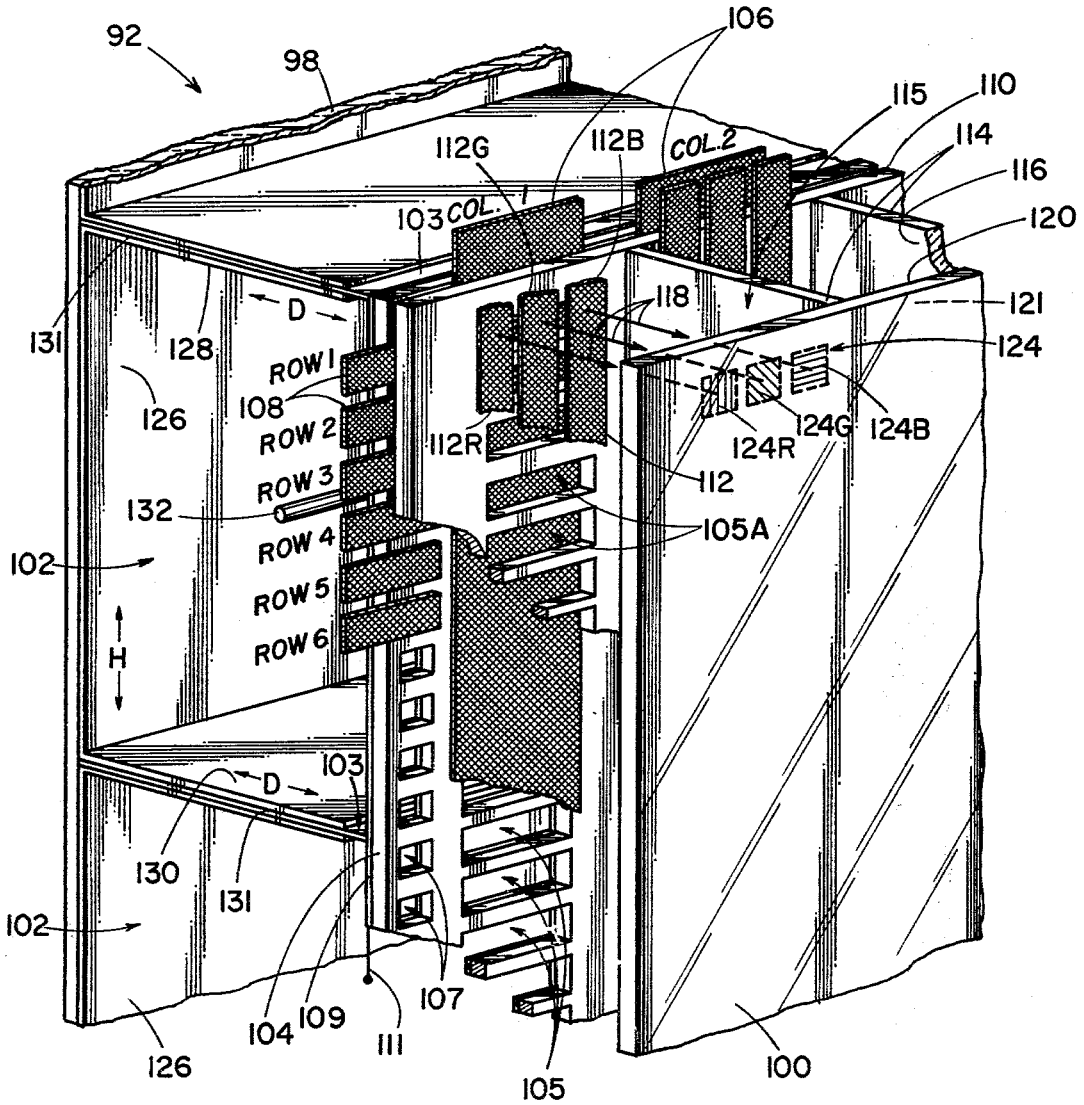
FIG. 6 is a schematic fragmentary perspective view, broken away, of a display panel representing a preferred embodiment of the invention.

Referring now to FIG. 6, a section of a full display panel structure according to this invention is shown, comprising a very low pressure, high-voltage gas discharge image display panel 92 having a rod-and-column array of display elements. Column 1 of the array comprises the left-most column of the display from the viewer's aspect. In TV applications, for example, the array may comprise five hundred columns across the width of the panel, with the columns extending from top to bottom of the display area. There also may be five hundred rows of display elements of the array extending the entire depth of the panel. In addition, there may be about fifty row-wise extending hollow cathodes, each providing for ten rows of display elements, as in this example.

The primary components of the preferred embodiment 92 are listed from back wall 98 to front of the panel which comprises transparent faceplate 100. Located toward the back of the panel are the electron source means for producing at a given time at least one high-density electron beam, the means comprising the following components. Contiguous to back wall 98 is a rearwardly disposed array of large-area hollow cathodes 102, each spanning a predetermined plural number of rows (here ten) and columns (here all), and capable of supplying copious electrons at the aforedescribed predetermined very low gas pressure. Each hollow cathode is electrically discrete and receives a relatively low voltage; for example, minus 300 volts. Hollow cathode 102 is comprised of top plate 128 and bottom plate 130 which are electrically isolated from forwardly located adjacent structures by insulators 103. Each hollow cathode 102 is electrically isolated from adjacent cathodes by insulators 131 located therebetween. An ignitor wire 132 extends row-wise in the center area of each hollow cathode 102 for priming the associated cathode.

The constriction-forming means comprises a barrier 104 located between anodes 106 and cathodes 102 and defines a plurality of narrow openings (constrictions) 105 each associated with one or more cathodoluminescent target elements 124 or "display elements. In the preferred embodiment of this invention, barrier 104 comprises a planar-form insulative means having at least one constriction therein for each display cell, and about which is selectively formed a plasma sac. (Plasma sacs are not shown by FIG. 6.) As described in the foregoing in relation to FIG. 4, the plasma sac, by its nature, gathers electrons from a large surrounding area of the associated hollow cathode 102 and accelerates them into the associated constriction to form a concentrated electron beam therein. In the preferred embodiment there are preferably about 250,000 constrictions 105 in barrier 104.

Performance enhancement electrode 108 is shown as being located contiguous to and parallel with barrier 104 and on the cathode side of the barrier and co-extensive without interruption across the width and height of panel 92. Electrode 109 receives through a single input terminal 111 a voltage intermediate to the relatively intermediate voltage on anodes 106 and the relatively low voltage on hollow cathodes 102. In the preferred embodiment of this invention, performance enhancement electrode may have an opening in alignment with each of the constrictions 105 in barrier 104, with both in registration. About each of said registered constrictions, and on the cathode side of barrier 104, a plasma sac may form as described in the foregoing.

Located forwardly of cathode 102 and performance enhancement electrode 109 are column-wise oriented electron-transmissive anodes 106 arranged in columns as shown. Each anode 106 covers a column of constrictions 105 in barrier 104, also as shown. Anodes 106 are electrically discrete and receive a relatively intermediate applied voltage. The combination of cathode 102, anodes 106, and barrier 104, together with said intermediate voltage, the predetermined distance between cathode 102 and anode 106, the very low gas pressure, and the individual width of the registered constrictions having values effective to support a gas discharge plasma between cathode 102 and anodes 106 to cause a plasma sac to form in the plasma on the cathode side of barrier 104 about the constriction of any selected anode 106.

A single column of row-select grids 108 lie in the same plane as anodes 106 and provide for the selection of the row to be scanned in the panel. Barrier 104 defines a plurality of narrow constrictions 107 associated with row-select electrodes 108. It will be noted that each row-select grid extends row-wise only far enough to cover only one column of constrictions 107 in barrier 104. A plasma sac for initiating row-wise scanning is started at the beginning of any row by the energizing of the associated row-select grid 108.

Spacer 110 may be a planar-form insulator having a plurality of openings 105A in registration with openings 105 of barrier 104. It will be noted that there are no constrictions in spacer 110 in registration with constrictions 107 in the column of row-select grids 108 as this column is not a light-emissive display element.

Adjacent to spacer 110 are located modulation grids 112 arranged in columns extending vertically the full height of the panel and substantially parallel to anodes 106. The configuration of modulation grids 112 comprises a trio of grids numbered 112R, 112G, 112B for modulation of triads of cathodoluminescent target elements respectively associated with red, green and blue picture information of a color television display panel. The high-density electron beam which is co-extensive with the predetermined group of cathodoluminescent target elements 124R, 124G, and 124B is similarly divided into a plurality of beamlets 118, one for each element in said group.

Ultor anode 120 is disposed contiguous to a layer of cathodoluminescent material which defines the target elements 124 on transparent faceplate 100. Ultor electrode 120 receives a predetermined relatively high ultor voltage; that is a voltage in the range of many hundreds to tens of thousands of volts; preferably four to twenty kilovolts. Ultor anode 120 is separated by a predetermined spacing from modulation grid 112 to define an acceleration section 115 therebetween. The spacing is so small that at the predetermined very low pressure and at the cited ultor voltage, no gas discharge plasma can possibly occur in acceleration section 115. The ultor voltage establishes a high-voltage gradient in the plasma-free acceleration section 115 which is effective to straight-line accelerate beamlets 118 in substantially collision-free paths directly into high-energy bombardment of target elements 124 disposed on the inner surface of transparent faceplate 100.

The plurality of electron-transmissive modulating grids 112R, 112G, and 112B are located down-beam of anode 106 and are respectively associated with a group of target elements 124R, 124G, and 124B for effectively dividing the beam into a like plurality of beamlets 118. Beamlets 118 are individually modulated with a like plurality of time-varying voltages to provide in cooperation with anode 106 full control of beamlets 118, wherein a range of differences in potential between anode 106 and modulating grids 112R, 112G, and 112B provide a related range of differences in electron current in each of beamlets 118. Thus, a related range of differences in luminous output from the cathodoluminescent target elements 124R, 124G, and 124B respectively associated with a plurality of display elements is achieved.

The triad of target elements 124R, 124G, 124B represents one group of such elements in a color display. In a panel comprising 500 rows and 500 columns of such elements, each of which comprises three discrete colors, there would be a total of 750,000 target elements. In a simple monochrome image display capable of intermediate gray tones, modulation grids 112 would be one continuous row-wise and column-wise extending grid. For a simpler monochrome display of limited intermediate gray tones (as previously described), modulation grids 112 would not be used in the panel and the sole grid means would comprise the electron transmissive anodes 106, one for each column, for providing a monochrome image display relatively devoid of intermediate gray tones. (The row-select grids would of course be utilized in a monochrome display.) Similarly, the triads of target elements 124R, 124B, and 124G respectively associated with red, blue, and green picture information would instead each comprise a monochrome light-emitting phosphor disposed on an inner surface of transparent faceplate 100.

Spacer 110 is shown as being spaced from faceplate 100 by a plurality of panel support members 114. There may be one panel support member 114 disposed between each of the columnns, or, the support members may be dispersed, with many columns between each support member. These support members may be row-wise extending, or, a combination of row- and column-wise-extending members. These support members, together with the top and bottom plates exemplified by 128 and 130 of the row-wise extending hollow cathodes and the insulators 103 against which they abut, provide the back-to-front internal bridging support which makes the display panel self-supporting against atmospheric pressure. The material comprising panel support members 114 may, for example, be a high-strength ceramic. To prevent build-up of electrostatic charges, panel support members 114 may, for example, be coated with a conductive material 116 having a very high electrical resistance.

In the preferred embodiment implementing the applicant's invention, panel support members 114 provide a spacing of 0.125 inch between spacer 110 and faceplate 100. The spacing dimension is dependent primarily upon the potential on ultor anode 120 which may be in the range of many hundreds to tens of thousands of volts, for example, and is a function of the gas pressure within display panel 92. The gas pressure-distance cited as an example in the foregoing, that is, 0.06 torr-centimeters for nitrogen and a spacing of 0.125 inch, provides a high-voltage breakdown resistance of the interspace in the range of four to twenty kilovolts depending on gas mixture, field emission points, and low work function surfaces that may liberate electrons and initiate a gas breakdown. Of all of these factors, a low value of Pd is of primary importance. Any value of Pd selected must be such as to prevent the propagation of a gas discharge forward of the preferred discharge area as too high a pressure could result in an undesired secondary discharge between ultor anode 120 and modulation grids 112. As a result, it could not be possible to maintain a high enough ultor anode voltage for adequate excitation of the cathodoluminescent target elements.

With regard to general structure, back wall 98 may comprise a material such as glass or other insulative material that can lend strength and rigidity to the panel 92. Back wall 98 serves both as a component of the outer envelope 92, and as a support member for the plurality of row-wise extending hollow cathodes 102.

The material from which the plates of hollow cathode 102 are preferably made comprises thin metal strips having a thickness of some two to five mils, or alternately, thick film or thin films disposed on insulative walls. If metal strips are used, metals having an expansion co-efficient substantially the same as that of glass should be used (assuming that the panel enclosure is made of glass); also, the metal may be hermetically sealable with glass, it must have a low work function, and be resistant to sputtering. Good results have been obtained with plates made with metal designated as Carpenter 42-6, available from Carpenter Technology, Inc., of Reading, Pa.

Dimensions of significance to the proper operation of hollow cathode 102 include the depth of top plate 128 and bottom plate 130 as shown by the distance "D" in FIG. 6. Generally, the spacing "H" between top plate 128 and bottom plate 130 is selected to be between 0.1 and 3.0 times the length of the cathode fall of a planar (as opposed to hollow) cathode made of the same metal as plates 128 and 130 and operating in an atmosphere of the same gas and at the same pressure at which the cited plates are operated. In the FIG. 6 embodiment, the spacing "H" between top plate 128 and bottom plate 130 is approximately equal to the height of ten rows of picture elements in a fifty-inch diagonal measurement display. The depth "D" of hollow cathode 102 is preferably approximately 1½ inches and the distance "H" between top plate 128 and bottom plate 130 is preferably approximately ¾ inch, in this embodiment.

Light-stopping means 121 may comprise a film of aluminum evaporated on the inner surface of faceplate 100. Since such a film is metallic and hence electrically conductive, it could also comprise the ultor anode.

With regard to display panel fabrication, techniques well-known to those skilled in the art may be used. For example, barrier 104 and spacer 110 and the openings therein may be fabricated by means such as photo-forming or thick-film screening. Also, other well-known techniques such as glass molding, etching, shaping and perforating may be utilized.

With regard to the composition of the grids, insulators and spacers illustrated by the several figures, anodes 106 and modulating grids 112 may be comprised of an electrically conductive electron-transmissive mesh or grid fabricated from a material such as a stainless steel alloy. Barrier 104 and spacer 110 may be comprised of a dielectric material such as a ceramic with a thickness range of, for example, two to twenty mils. Barrier 104 and spacer 110 serve to define the geometry of the electron beam, separate the grids, and impart structural strength to the panel. Openings or constructions such as those shown by 105, 105A and 107 of FIG. 6, may as well be in the form of circles, ovals, slots, or, rectangles as shown, and be either horizontally or vertically oriented. The rectangular configuration of the openings or constructions as shown, represents the preferred embodiment of the invention, as this configuration is deemed to be one most suitable for the activation of target elements comprising color.

A construction technique that provides for great accuracy of registration and inherent supportive strength of the insulative structure, coupled with ease and economy of manufacture, involves building up insulative sections from glass filaments. This technique does not constitute an aspect of this invention, but is described and claimed in U.S. Pat. No. 4,099,082. The resulting structure resembles a log cabin. The glass filaments are strung on an external harp-like jig that keeps the filaments taut and in place until they have been rigidified, as by spraying with a suspension of low-melting point solder glass (frit). The resulting structure is fired to a temperature wherein the frit reaches its melting point and flows between the filaments, which have a higher melting point, to fasten them together permanently. A structure has been fabricated which tests show is able to withstand a pressure of over 2,000 pounds per square inch with dimensions maintained to within 0.002 inch during the firing cycle.

Concerning the selection of material for the panel generally, it is preferable that all materials have relatively the same coefficient of expansion. This coefficient is in turn based upon the flow temperature of the glass frit used to solder the panel sections together during the fritting cycle. All parts must expand and contract in concert to prevent cracking of glass and ceramic members, and to prevent component separation or changes in spacings. Expansion-compatible material suitable for panel construction are well known. Two widely used and representative materials that would lend themselves to construction of a display panel according to the preferred embodiment are glass of the soda-lime type, and metal sections of the aforementioned Carpenter 42-6.

With regard to the composition of the cathodoluminescent material, the following commercially available phosphors are representative of those suitable for the electron-acceleration voltage values of the preferred embodiment of this invention:

RED $Y_2O_2S:Eu^{+3}$

GREEN $La_2O_2S:Tb^{+3}$

BLUE $Sr_5Cl(PO_4):Eu^{+2}$

The weight of a self-supporting fifty-inch diagonal measure image display panel according to this invention has been determined to be between fifty and fifty-five pounds, a weight which compares most favorably with a fifty pound weight of the conventional non-self-supporting twenty-five inch color television picture tube which, it will be noted, has only one-quarter the image display area.

Figure 8:
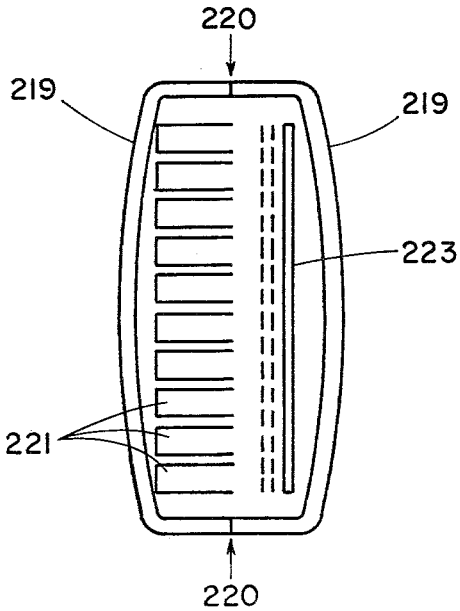
FIG. 8 shows in highly schematic form the structure of the preferred embodiment of the invention enclosed within two facing standard picture tube faceplates.

The structure of the preferred embodiment of the invention illustrated in FIG. 6 and described in the foregoing may be embodied in a non-self-supporting display panel as shown by FIG. 8. In this embodiment, the display panel 92 structure shown by FIG. 6 is disposed within two facing standard picture tube faceplates 219 whose mating edges 220 are sealed to form an air-tight envelope. A row of hollow cathodes 221 are shown along with a faceplate 223 and associated grids, insulators and spacers as have been described.

Figure 9:
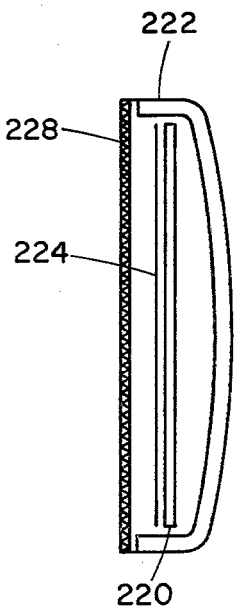
FIG. 9 shows in highly schematic form the structure of the preferred embodiment of the invention enclosed within a modified television picture tube faceplate wherein a planar cathode is utilized.

FIG. 9 shows another embodiment of the invention, indicated in highly schematic form by 220, enclosed within a single television picture tube faceplate 222. In this aspect of the preferred embodiment, electrons are shown as being supplied by a planar cathode 224 such as a gas discharge planar cathode, field emission cathode, or thermionic cathode. Back wall 228, which may be of honeycomb structure for strength and rigidity, hermetically seals the back section of faceplate 222 to complete the structure.

A brightness-optimized cathodoluminescent gas discharge image display panel suitable for the display of television picture images has been described and illustrated. The preferred embodiment of the invention as disclosed is an example of only one of many possible applications. It can be effectively utilized for the display of visual information of several kinds. Because of its space-saving, flat configuration and light weight, it can replace the bulky, heavy cathode ray picture tube display in locations where space is at a premium, such as in an aircraft or spacecraft cockpit, as well as in the homes of consumers. The invention brings to such applications the same benefits as high brightness, luminance efficiency, high resolution, and excellent contrast of the standard television picture tube, as well as a range of display area dimensions much greater than that supplied by the picture tube.

Other changes may be made in the above-described apparatus without departing from the true spirit and scope of the invention herein involved. For example, in the FIG. 5 embodiment, the constriction means 66 is illustrated as taking the form of an insulator having one or more openings therein—i.e., physical constrictions. It is contemplated that the constriction means could as well be means which define an electrically constricting field, rather than an opening or other physical constriction in a structural member.

Figure 10:
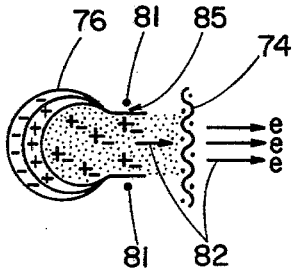
FIG. 10 shows alternative means for forming a constriction wherein electrodes form a constricting field according to this invention.

FIG. 10 is analogous to FIG. 5 and illustrates such an alternative embodiment. It will be noted that the constriction 68 of FIG. 5 has been replaced by a field-forming electrode 81, here shown in cross-section as a pair of wires. By the application of an appropriate voltage to electrode 81, which, for example, may be in the order of one hundred volts or less, a constricting field is formed which contributes to the formation of plasma sac 76. The effect of the constricting field in constricting the gas discharge plasma is analogous to the effect of the insulator shown by FIG. 5 with its narrow constriction. The field-forming electrode 81 could as well be in the form of bars, rods, plated-on sections, metallized glass-filaments, or any other configuration suitable for the purpose of electrically imposing a constricting field upon the plasma established forwardly of the cathode.

It is intended therefore that the subject matter in the foregoing depiction shall be interpreted as illustrative and not in a limiting sense.

I claim:

1. A very low pressure, high-voltage cathodoluminescent gas discharge image display panel having an ordered array of display elements, the panel including envelope means containing an ionizable gas at a predetermined very low pressure, said envelope means including a transparent faceplate on the inner surface of which are disposed cathodoluminescent target elements associated with said display elements, the panel comprising:

electron source means for producing at a given time at least one high-density electron beam, comprising:

rearwardly disposed cathode means for receiving a relatively low applied voltage;

grid means located forwardly of said cathode means and including at least an electron-transmissive anode means spaced a predetermined distance from said cathode means for receiving a relatively intermediate applied voltage, and further including a performance enhancement electrode located between said anode means and said cathode means, and co-extensive without interruption across the width and height of said panel, said performance enhancement electrode receiving through a single input terminal a voltage intermediate said relatively intermediate voltage on said anode means and said relatively low voltage on said cathode means, said performance enhancement electrode serving to stabilize said plasma sac in said constriction by conducting electrons from a surrounding area to said sac, thus discouraging the formation of a sac in non-energized neighboring constrictions, said performance enhancement electrode also serving to prime the contained gas in the region of said constriction and thereby permitting a plasma sac to be established in said constriction by application of a lower voltage on said anode means than otherwise possible;

constriction-forming means between said anode means and said cathode means defining a plurality of constrictions each respectively associated with one or more of said display elements, with said intermediate voltage, said predetermined distance, said very low gas pressure, and the individual width of said constrictions having values effective to support a gas discharge plasma between said cathode means and said anode means, and to cause a plasma sac to form in said plasma on the cathode side of said constriction-forming means about the constriction associated with any selected anode means, said plasma sac by its nature generating and gathering electrons from said cathode means and accelerating them into said constriction to form a concentrated electron beam therein;

an ultor electrode disposed contiguous to said cathodoluminescent target elements on said faceplate for receiving a predetermined relatively high ultor voltage, said ultor electrode being separated by a predetermined spacing from said grid means to define an acceleration section therebetween, said spacing being so small that at said predetermined very low pressure and at said ultor voltage, no gas discharge plasma can possibly occur in the acceleration section, said ultor voltage establishing a high-voltage predient in the plasma-free acceleration section which is effective to straight-line accelerate said beam of electrons formed in said constriction in a substantially collision-free path directly into high-energy bombardment of said cathodoluminescent target elements disposed on said faceplate; and light-stopping means for blocking from view light produced by said plasma, whereby the useful visible light produced by said panel is solely that produced by said high-energy elelctron bombardment of said cathodoluminescent target elements on said faceplate.

2. A very low pressure, high-voltage cathodoluminescent gas discharge image display panel having an ordered array of display elements, the panel including envelope means containing an ionizable gas at a predetermined very low pressure, said envelope means including a transparent faceplate on the inner surface of which are disposed cathodoluminescent target elements associated with said display elements, the panel comprising:

electron source means for producing at a given time at least one high-density electron beam, comprising:

rearwardly disposed cathode means for receiving a relatively low applied voltage;

grid means located forwardly of said cathode means and including a performance enhancement electrode at a distance $D_1$ from said cathode means and an anode means at a greater distance $D_2$ from said cathode means, said anode means being electron-transmissive and receiving a relatively intermediate applied voltage; and constriction-forming means between said anode means and said performance enhancement electrode and defining at least one constriction registered with a constriction in said performance enhancement electrode, said registered constrictions being respectively associated with one or more of said display elements, with said intermediate voltage, said distance $D_2$, said very low pressure, and the width of said registered constrictions having values effective to support a gas discharge plasma between said cathode means and said anode means to cause a plasma sac to form in said plasma about said constriction in said performance enhancement electrode on the cathode side of said barrier means, said plasma sac by its nature generating and gathering electrons from said cathode means and accelerating them into said registered constrictions to form a concentrated electron beam therein, said performance enhancement electrode being co-extensive without interruption across the width and height of the panel and receiving a voltage intermediate said relatively intermediate voltage on said anode means and said relatively low voltage on said cathode means, said performance enhancement electrode serving to stabilize said plasma sac in said registered constrictions by conducting electrons from a surrounding area to said sac, and at the same time discouraging the formation of a sac in non-energized neighboring display elements, said performance enhancement electrode also serving to prime the contained gas in the region of said constriction and thereby permitting a plasma sac to be supported in said constriction by application of a lower voltage on said anode means than otherwise possible;

an ultor electrode disposed contiguous to said cathodoluminescent material on said faceplate for receiving a predetermined relatively high ultor voltage; that is, a voltage in the range of many hundreds to tens of thousands of volts, said ultor electrode being separated by a predetermined spacing from said grid means to define an acceleration section therebetween, said spacing being so small that at said predetermined very low gas pressure and at said ultor voltage, no gas discharge plasma can possibly occur in the acceleration section, said ultor voltage establishing a high-voltage gradient in the plasma-free acceleration section which is effective to straight-line accelerate said beam of electrons formed in said narrow opening in a substantially collision-free path directly into high-energy bombardment of said cathodoluminescent target elements disposed on said faceplate; and light-stopping means for blocking from view light produced by said plasma, whereby the useful visible light produced by said panel is solely that produced by said high-energy electron bombardment of said cathodoluminescent target elements on said faceplate.

3. The display panel defined by claim 2 wherein said grid means comprises said anode means and at least one electron-transmissive modulating grid means located down-beam of said anode means for modulating said concentrated electron beam with a time-varying voltage to provide in cooperation with said anode means full control of said electron beam wherein a range of differences in potentials between said anode means and said modulating grid means provides a related range of differences in electron current and thus a related range of differences in luminous output from said cathodoluminescent target elements.

4. A very low pressure, high-voltage cathodoluminescent gas discharge image display panel having an ordered array of display elements, the panel including envelope means containing an ionizable gas at a predetermined very low pressure, said envelope means including a transparent faceplate on the inner surface of which are disposed cathodoluminescent target elements associated with said display elements, the panel comprising:

electron source means for producing at a given time at least one high-density electron beam, comprising:

rearwardly disposed cathode means for receiving a relatively low applied voltage;

grid means located forwardly of said cathode means and including a performance enhancement electrode at a distance $D_1$ from said cathode means and an anode means at a greater distance $D_2$ from said cathode means, said anode means being electron-transmissive and receiving a relatively intermediate applied voltage, and further including at least one electron-transmissive modulating grid means located down-beam of said anode means for modulating said concentrated electron beam with a time-varying voltage to provide in cooperation with said anode means full control of said electron beam wherein a range of differences in potentials between said anode means and said modulating grid means provides a related range of differences in electron current and thus a related range of differences in luminous output from said cathodoluminescent target elements;

constriction-forming means between said anode means and said performance enhancement electrode and defining at least one constriction registered with a constriction in said performance enhancement electrode, said registered constrictions being respectively associated with one or more of said display elements, with said intermediate voltage, said distance $D_2$, said very low pressure, and the width of said registered constrictions having values effective to support a gas discharge plasma between said cathode means and said anode means to cause a plasma sac to form in said plasma about said constriction in said performance enhancement electrode on the cathode side of said barrier means, said plasma sac by its nature generating and gathering electrons from said cathode means and accelerating them into said registered constrictions to form a concentrated electron beam therein, said performance enhancement electrode being co-extensive without interruption across the width and height of the panel and receiving a voltage intermediate said relatively intermediate voltage on said anode means and said relatively low voltage on said cathode means, said performance enhancement electrode serving to stabilize said plasma sac in said registered constrictions by conducting electrons from a surrounding area to said sac, and at the same time discouraging the formation of a sac in non-energized neighboring display elements, said performance enhancement electrode also serving to prime the contained gas in the region of said constriction and thereby permitting a plasma sac to be supported in said constriction by application of a lower voltage on said anode means than otherwise possible;

an ultor electrode disposed contiguous to said cathodoluminescent material on said faceplate for receiving a predetermined relatively high ultor voltage; that is, a voltage in the range of many hundreds to tens of thousands of volts, said ultor electrode being separated by a predetermined spacing from said grid means to define an acceleration section therebetween, said spacing being so small that at said predetermined very low gas pressure and at said ultor voltage, no gas discharge plasma can possibly occur in the acceleration section, said ultor voltage establishing a high-voltage gradient in the plasma-free acceleration section which is effective to straight-line accelerate said beam of electrons formed in said narrow opening in a substantially collision-free path directly into high-energy bombardment of said cathodoluminescent target elements disposed on said faceplate; and light-stopping means for blocking from view light produced by said plasma, said light-stopping means including a continous, light-reflective film disposed on said cathodoluminescent target elements which is also electrically conductive and serves as said ultor electrode, whereby the useful visible light produced by said panel is solely that produced by said high-energy electron bombardment of said cathodoluminescent target elements on said faceplate.

5. A very low pressure, high-voltage cathodoluminescent gas discharge image display panel having an ordered array of display elements, the panel including envelope means containing a ionizable gas at a predetermined very low pressure, said envelope means including a transparent faceplate on the inner surface of which is disposed cathodoluminescent target elements associated with said display elements, the panel comprising:

electron source means for producing at a given time at least one high-density electron beam which is co-extensive with a predetermined group of display elements and which is divided into a plurality of beamlets, one for each element in said group, said electron source means comprising:

rearwardly disposed large-area cathode means for receiving a relatively low applied voltage;

grid means located forwardly of said cathode means and including at least an electron-transmissive anode means co-extensive with said group of elements for receiving a relatively intermediate applied voltage, said grid means including a performance enhancement electrode located between said anode means and said cathode means and coextensive without interruption across the width and height of said panel, said performance enhancement electrode receiving through a single input terminal a voltage intermediate said relatively intermediate voltage on said anode means and said relatively low voltage on said cathode means, said performance enhancement electrode serving to stabilize said plasma sac in said constriction by conducting electrons from a surrounding area to said sac and at the same time discouraging the formation of a sac in non-energized neighboring constrictions, said performance enhancement electrode also serving to prime the contained gas in the region of said constriction and thereby permitting a plasma sac to be established in said constriction by application of a lower voltage on said anode means than otherwise possible;

barrier means between said anode means and said cathode means and defining a narrow constriction associated with said group of display elements, with said intermediate voltage, said predetermined distance, said very low gas pressure, and the individual width of said constriction having values effective to support a gas discharge plasma between said cathode means and said anode means and to cause a plasma sac to form in said plasma on the cathode side of said barrier means about said constriction, said plasma sac by its nature generating and gathering electrons from said plasma and accelerating them into said constriction to form a concentrated electron beam therein;

a plurality of electron-transmissive modulating grids located down-beam of said anode means and respectively associated with said group of elements for effectively dividing said beam into a like plurality of beamlets, and for individually modulating said electron beamlets with a like plurality of time-varying voltages to provide in cooperation with said anode means full control of said electron beamlets wherein a range of differences in potential between said anode means and said modulating grids provides a related range of differences in electron current in each of said beamlets and thus a related range of differences in luminous output from the cathodoluminescent target elements respectively associated with said plurality of display elements; and an ultor electrode disposed contiguous to said cathodoluminescent target elements on said faceplate for receiving a predetermined relatively high ultor voltage; that is, a voltage in the range of many hundreds to tens of thousands of volts, said ultor anode being separated by a predetermined spacing from said grid means to define an acceleration section therebetween, said spacing being so small that at said predetermined very low pressure and at said ultor voltage, no gas discharge plasma can possibly occur in the acceleration section, said ultor voltage establishing a high-voltage gradient in the plasma-free acceleration section which is effective to straight-line accelerate said beamlets in substantially collision-free paths directly into high-energy bombardment of said cathodoluminescent target elements disposed on said faceplate.

6. A very low pressure, high-voltage cathodoluminescent gas discharge image display panel having a row-and-column array of display elements, the panel including envelope means containing an ionizable gas at a predetermined very low pressure; that is, a fraction of a torr, said envelope means including a transparent faceplate on the inner surface of which are disposed cathodoluminescent target elements associated with said display elements, the panel comprising:

electron source means for producing at a given time at least one high-density electron beam, comprising:

a rearwardly disposed array of large-area hollow cathodes, each spanning a predetermined plural number of rows and columns, and capable of supplying copious electrons at said predetermined very low pressure, and for receiving a relatively low voltage;

grid means located forwardly of said hollow cathode means and including at least one electron transmissive anode means for receiving a relatively intermediate applied voltage, said grid means further including a performance enhancement electrode located between said anode means and said cathode means, and co-extensive without interruption across the width and height of said panel, said performance enhancement electrode receiving through a single input terminal a voltage intermediate said relatively intermediate voltage on said anode means and said relatively low voltage on said cathode means, said performance enhancement electrode serving to stabilize said plasma sac in said constriction by conducting electrons from neighboring display elements to said sac, and thus discouraging the formation of a plasma sac in non-energized neighboring display elements, said performance enhancement electrode also serving to prime the contained gas in the region of said constriction and thereby permitting a plasma sac to be established in said constriction by application of a lower voltage on said anode means than otherwise possible;

barrier means between said anode means and said cathode means defining a plurality of constrictions each associated with said display elements, with said intermediate voltage, said predetermined distance, said very low gas pressure, and the individual widths of said constrictions having values effective to support a gas discharge plasma between said cathode means and said anode means and to cause a plasma sac to form in said plasma on the cathode side of said barrier means about the constriction associated with any selectively energized anode means, said plasma sac by its nature generating and gathering electrons from a large surrounding area of the associated hollow cathode and accelerating them into said constriction to form a concentrated electron beam therein;

an ultor electrode disposed contiguous to said cathodoluminescent target elements on said faceplate for receiving a predetermined relatively high ultor voltage; that is, a voltage in the range of many hundreds to tens of thousands of volts, said ultor electrode being separated by a predetermined spacing from said grid means to define an acceleration section therebetween, said spacing being so small that at said predetermined very low gas pressure and at said ultor voltage, no gas discharge plasma can possibly occur in the acceleration section, said ultor voltage establishing a high-voltage gradient in the plasma-free acceleration section which is effective to straight-line accelerate said beam of electrons formed in said constriction in a substantially collision-free path directly into high-energy bombardment of said cathodoluminescent target elements disposed on said faceplate; and light-stopping means for blocking from view light produced by said plasma, whereby the useful visible light produced by said panel is solely that produced by said high-energy electron bombardment of said cathodoluminescent target elements on said faceplate.

* * * * *